US009242385B2

(12) United States Patent
Erickson

(10) Patent No.: US 9,242,385 B2
(45) Date of Patent: Jan. 26, 2016

(54) DRIVE ASSEMBLY FOR HAIR TRIMMERS

(71) Applicant: Gary Erickson, Lena, IL (US)

(72) Inventor: Gary Erickson, Lena, IL (US)

(73) Assignee: Wahl Clipper Corporation, Sterling, IL (US)

( * ) Notice: Subject to any disclaimer, the term of this patent is extended or adjusted under 35 U.S.C. 154(b) by 306 days.

(21) Appl. No.: 13/895,525

(22) Filed: May 16, 2013

(65) Prior Publication Data

US 2014/0338199 A1 Nov. 20, 2014

(51) Int. Cl.
*B26B 19/06* (2006.01)
*B26B 19/38* (2006.01)

(52) U.S. Cl.
CPC ..... *B26B 19/06* (2013.01); *B26B 19/3846* (2013.01)

(58) Field of Classification Search
CPC ..... B26B 19/06; B26B 19/3846
See application file for complete search history.

(56) References Cited

U.S. PATENT DOCUMENTS 2,182,597 A * 12/1939 Oster ..... 30/210
2,533,946 A * 12/1950 Levesque ..... 310/47
2,542,378 A * 2/1951 Cecil ..... B26B 19/06 30/208
2,928,171 A * 3/1960 Oster ..... B26B 19/06 30/221
3,222,781 A * 12/1965 Ulke et al. ..... 30/210
3,279,062 A * 10/1966 Andis ..... 30/210
3,747,212 A * 7/1973 Krayl ..... B26B 19/06 30/221
3,967,372 A 7/1976 Beck et al.
4,118,863 A 10/1978 Sandy
4,249,307 A * 2/1981 Andis ..... 30/216
4,989,324 A * 2/1991 Andis ..... 30/216
5,054,199 A * 10/1991 Ogawa et al. ..... 30/34.1
5,367,772 A * 11/1994 Ogawa ..... 30/201
5,745,995 A 5/1998 Yamashita et al.
6,421,922 B2 7/2002 Beutel et al.
6,502,312 B2 1/2003 Beutel et al.
6,536,116 B2 * 3/2003 Fung ..... 30/199
6,886,255 B2 * 5/2005 Freas ..... B26B 19/06 30/200
7,281,461 B2 10/2007 McCambridge et al.
7,509,743 B2 3/2009 Oh
8,713,802 B2 * 5/2014 Fukutani et al. ..... 30/208
2002/0000043 A1 * 1/2002 Beutel et al. ..... 30/216
2002/0170180 A1 * 11/2002 Brill et al. ..... 30/210
2006/0059696 A1 * 3/2006 Derby et al. ..... 30/210
2006/0283022 A1 * 12/2006 Oh ..... 30/216
2007/0107234 A1 * 5/2007 Yao ..... 30/201
2009/0144988 A1 * 6/2009 Lau ..... 30/208

(Continued)

FOREIGN PATENT DOCUMENTS

DE 103 02 998 A1 * 8/2004
DE 20 2010 011 783 A1 * 9/2011

(Continued)

*Primary Examiner* — Hwei C Payer
(74) *Attorney, Agent, or Firm* — Greer Burns & Crain Ltd.

(57) ABSTRACT

A hair trimmer has a base housing and a blade set having a stationary blade and a reciprocating blade. The base housing has a blade set support at one end. The support has a pair of spaced blade set support projections. A cam follower has spaced spring retainers near a bottom of the cam follower, and spaced spring end catches near an upper edge of the cam follower. A spring has elongated legs and a tension arm. The elongated legs extend under the spring retainers and into the spring end catches in the cam follower. A spring tensioner is secured in the base housing by a latch that engages a tensioner catch. The spring tensioner secures the tension arm so that the spring is under tension.

12 Claims, 4 Drawing Sheets

(56) References Cited

U.S. PATENT DOCUMENTS

2011/0061241 A1* 3/2011 Jian ..... B26B 19/06 30/201
2014/0338199 A1* 11/2014 Erickson ..... B26B 19/3846 30/216
2014/0352159 A1* 12/2014 Arndt ..... B26B 19/28 30/216

FOREIGN PATENT DOCUMENTS

EP 2 808 135 A1 * 12/2014
GB 2 248 52 A 5/1925

* cited by examiner

DRIVE ASSEMBLY FOR HAIR TRIMMERS

This invention relates to hair trimmers, and more particularly to drive assemblies for hair trimmers driven by a rotary motor or a vibrator motor.

BACKGROUND OF THE INVENTION

Hair trimmers use a rotary motor or a vibrator motor to drive a reciprocating blade. A typical drive assembly for a hair trimmer having a rotary motor includes a cam follower, a spring and a reciprocating blade guide. Such drive assemblies work well, but assembly of the hair trimmer is somewhat tedious and time consuming. Thus, there is a need for drive assemblies for hair trimmers that better facilitate assembly.

Accordingly, one object of this invention is to provide new and improved hair trimmers.

Another object is to provide new and improved drive assemblies for rotary motor driven hair trimmers and vibrator motor hair trimmers that facilitate assembly.

SUMMARY OF THE INVENTION

In keeping with one aspect of this invention, a hair trimmer has a base housing and a blade set having a stationary blade and a reciprocating blade. The base housing has a blade set support at one end. One end of the support opposite the blade set can be defined in part by a surface having a catch. The support also has a pair of spaced spring projections.

A cam follower has spaced spring retainers near a center or bottom edge of the cam follower, and spaced spring end catches near an upper edge of the cam follower.

A spring has elongated legs and a tension arm. The tension arm presses against a spring tensioner, and the elongated legs extend under the spring retainers and into the spring end catches in the cam follower.

The spring tensioner is secured in the base housing by a latch that engages the catch in the blade set support. The spring tensioner secures the tension arm towards the blade set support so that the spring is under tension.

The reciprocating blade is operably secured to the cam follower by a drive device connected to a rotary motor or a vibrator motor, and the stationary blade is secured to the base housing.

BRIEF DESCRIPTION OF THE DRAWINGS

The above mentioned and other features of this invention and the manner of obtaining them will become more apparent, and the invention itself will be best understood by reference to the following description of an embodiment of the invention taken in conjunction with the accompanying drawings, in which.

DETAILED DESCRIPTION

Figure 1:
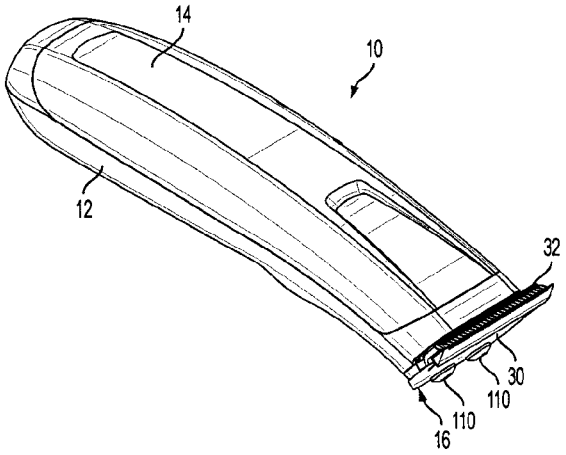
FIG. 1 is a perspective view of a hair trimmer having a rotary motor.

As seen in FIG. 1, the hair trimmer 10 has a base housing 12, a cover 14 and a blade set 16. A motor 18 (FIG. 2) a battery 20 and a switch 22 are provided. The motor 18 has a cam 24, and the cam 24 has an eccentric cam shaft 25 that drives the blade set 16, as will be seen.

Figure 4A:
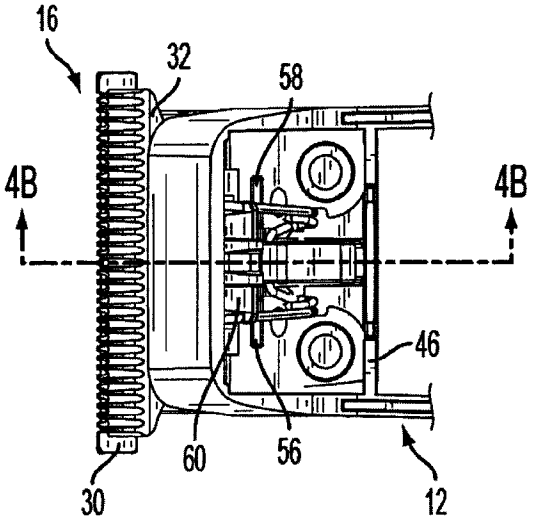
FIG. 4A is another partial view of the hair trimmer of FIG. 1, showing the drive assembly fully installed.
Figure 3A:
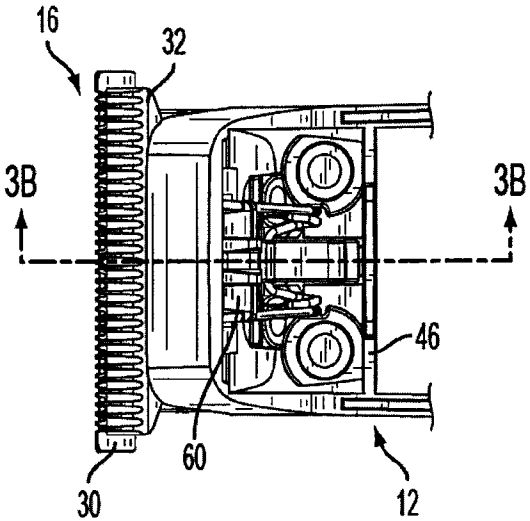
FIG. 3A is a partial view of the hair trimmer of FIG. 1, with the drive assembly partially installed.

The blade set 16 includes a stationary blade 30 and a reciprocating blade 32 (FIGS. 3A and 4A). The reciprocating blade 32 has an opening 34 (FIG. 5) which is used to drive the reciprocating blade 32, and a guide 36 (FIGS. 3B and 4B) that slidably fits in a groove of the stationary blade 30. The guide 36 guides the reciprocating blade 32 in a linear path during operation.

Figure 4B:
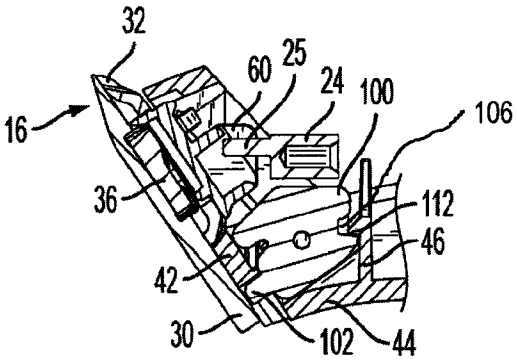
FIG. 4B is a cut-a-way view of FIG. 4A, taken along lines 4B-4B.
Figure 3B:
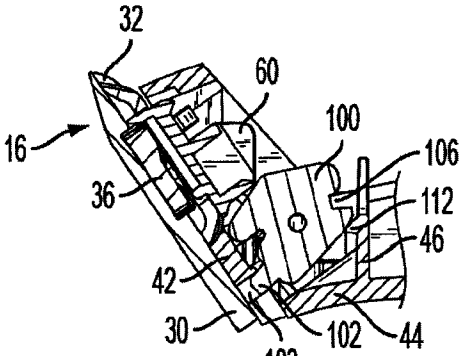
FIG. 3B is a cut-a-way view of FIG. 3A, taken along lines 3B-3B.
Figure 5:
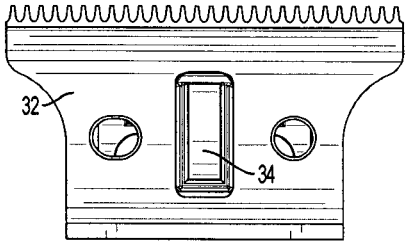
FIG. 5 is a plan view of a reciprocating blade used in the hair trimmer of FIG. 1.
Figure 6:
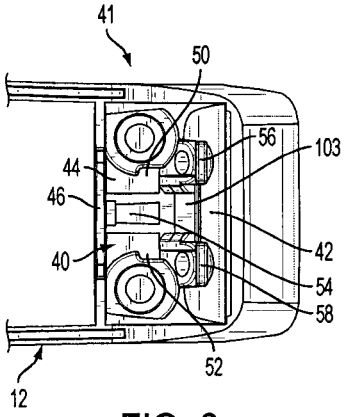
FIG. 6 is a partial view of the housing base used in the hair trimmer of FIG. 1, without the drive assembly installed.

Referring now to FIG. 6, the base housing 12 has a blade set support 40 at one end 41. The support 40 has a forward portion 42 and a lower portion 44 extending along the bottom of the base housing 12, and a motor mount 46. The lower portion 44 is at an oblique angle to the forward portion 42, as seen in FIGS. 3B and 4B. The motor mount 46 (FIG. 6) extends laterally across the base housing 12 opposite to the forward portion 42 to define a rearward portion of the blade set support 40. While a motor mount is shown here, rearward portion could be any other suitable structure, without being used to mount the motor.

The support 40 includes two spaced cavities 50, 52 on the inside surface of the lower portion 44. A basin 54 is formed between the cavities 50, 52. A pair of spaced projections 56, 58 are provided on the forward portion 42 of the support 40. The projections 56, 58 (FIG. 6) limit movement of a spring 80 (FIG. 7A) and a cam follower 60 (FIG. 4A) when the blades are removed, so that the cam shaft 25 remains in engagement with the cam follower 60.

Figure 7A:
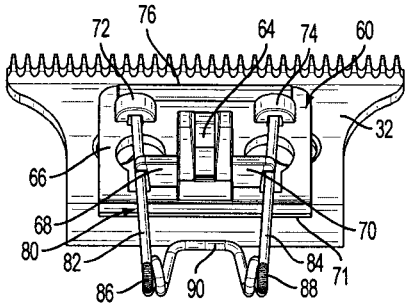
FIG. 7A is a plan view of an assembled drive assembly in the hair trimmer of FIG. 1, with a reciprocating blade.
Figure 7B:
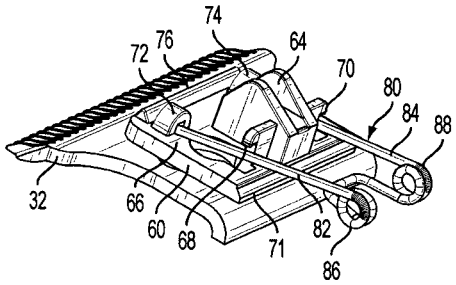
FIG. 7B is a perspective view of drive assembly shown in FIG. 7A.
Figure 7C:
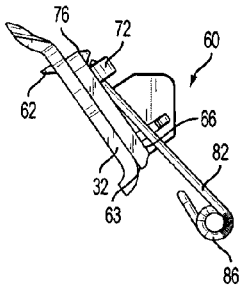
FIG. 7C is a side view of drive assembly shown in FIG. 7A.
Figure 8:
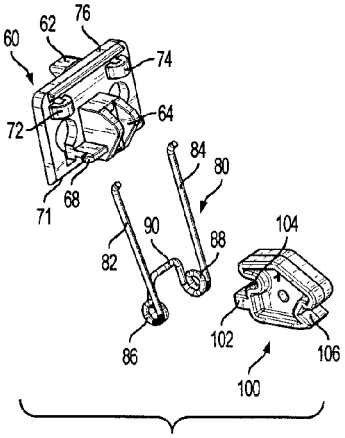
FIG. 8 is an exploded view of the drive assembly shown in FIG. 7A and the spring tensioner shown in FIGS. 3B and 4B.

As seen in FIGS. 7C and 8, the cam follower 60 has a blade protrusion 62 that fits in the opening 34 (FIG. 5) of the reciprocating blade 32 when assembled. The blade protrusion 62 is on a bottom face 63 (FIG. 7C) of the cam follower 60.

A cavity 64 (FIGS. 7A, 7B and 8) is provided on a top face 66 (FIG. 7C) of the cam follower 60. The cam shaft 25 fits in the cavity 64 (FIGS. 4B and 9) to drive the cam follower 60 back and forth when the motor 18 rotates the cam 24.

Spring retainers 68, 70 (FIGS. 7A, 7B) of the top face 66 are located near a bottom 71. Spring end catches 72, 74, are provided near an upper edge 76 of the top face 66.

As seen in FIG. 8, the spring 80 has elongated legs 82, 84, coils 86, 88 and a tension arm 90, preferably formed by a single piece of wire. The coils 86, 88 fit in the cavities 50, 52, as will be seen. The elongated legs 82, 84 are secured in the spring end catches 72, 74 in the cam follower 60, and the legs 82, 84 are drawn under the spring retainers 68, 70, as seen in FIGS. 7A, 7B and 7C.

A spring tensioner 100 (FIG. 8) includes a tensioner projection 102 that is placed in an opening 103 (FIG. 3B) in the base housing 12, a torsion bar groove 104, and a tensioner latch 106. When assembled, the spring tensioner 100 secures the tension arm 90 towards the forward portion 42 of the support 40 so that the spring 80 is under tension.

The reciprocating blade 32 is secured to the cam follower 60 by inserting the blade protrusion 62 in the opening 34. The stationary blade 30 is secured to the housing base support 12 by screws 110 (FIG. 1).

The drive assembly is assembled by installing the spring 80 in the cam follower 60, as has been described. The groove 104 in the spring tensioner 100 is placed over the tension arm 90 of the spring 80, and the coils 86, 88 are placed in the cavities 50, 52, as seen in FIGS. 3A and 3B. The spring tensioner 100 is then pressed down until the tensioner latch 106 passes a tensioner catch 112 in the motor mount 46, as seen in FIGS. 4A and 4B.

Figure 2:
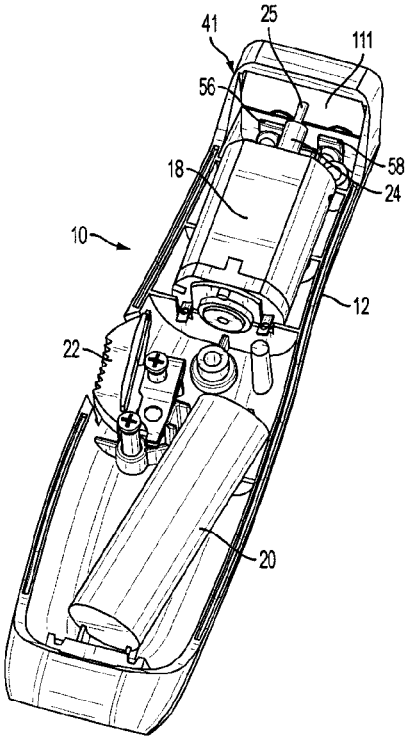
FIG. 2 is a perspective view of the inside of the hair trimmer of FIG. 1.

When the drive assembly is installed in this manner, the cam follower 60 passes through an opening 111 in the housing base 12 (FIG. 2). However, its movement is limited by the projections 56, 58. The cam follower 60 is self-supporting when the blades are not present because the projections 56, 58 prevent the spring legs 82, 84 from extending too far past the opening 111. The spring retainers 68, 70 also limit movement of the cam follower 60 when the blades are not present, and prevent the spring legs 82, 84 from becoming dislodged from the cam follower 60.

When the drive assembly is installed, the reciprocating blade 32 can be placed over the blade protrusion 62, and the stationary blade 30 can be secured over the reciprocating blade by the screws 110. When the blades are secured, the spring 80 is not in contact with the projections 56, 58, or the spring retainers 68, 70. Thus, there is no interference with operation. However, if the blades are removed for maintenance or repairs, the drive assembly stays generally in place, making re-attachment of the blades a simple task.

Figure 9:
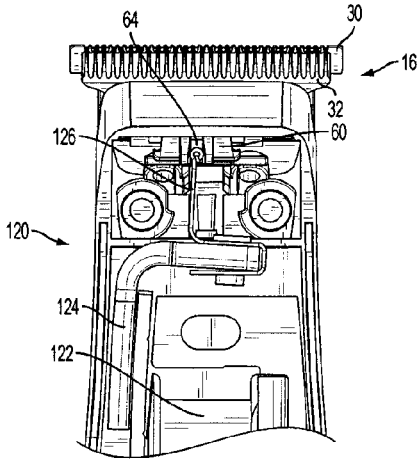
FIG. 9 is a partial view of a hair trimmer having a vibrator motor.

The drive assembly shown in FIGS. 1-8 can be used with a vibrator motor, as seen in FIG. 9. A hair trimmer 120 includes a vibrator motor 122 having a vibrating arm 124. A drive arm 126 is provided at an end of the vibrating arm 124. The drive arm 126 fits in the cavity 64 of the cam follower 60, causing reciprocal motion of the cam follower 60 and the reciprocating blade when the vibrator motor operates.

The many advantages of this invention are now apparent. The drive assembly does not fall apart or come out when the blades are removed for cleaning, sharpening and/or replacement. In addition, the drive assembly is easily fabricated, assembled and installed.

While the principles of the invention have been described above in connection with specific apparatus and applications, it is to be understood that this description is made only by way of example and not as a limitation on the scope of the invention.

What is claimed is:

1. A hair trimmer comprising:

a base housing, a motor and a blade set, the blade set having a stationary blade and a reciprocating blade, the base housing having a blade set support at one end thereof, the blade set support having a pair of spaced blade set support projections, a cam follower having spaced spring retainers near a bottom of the cam follower, and spaced spring end catches near an upper edge of the cam follower, a spring having elongated legs, the elongated legs extending under the spring retainers and being secured by the spring end catches in the cam follower, the reciprocating blade being operably driven by the cam follower, the cam follower being driven by a drive device secured to the motor, and the stationary blade being secured to the base housing.

2. The hair trimmer of claim 1, wherein the blade set support has a tensioner catch, the hair trimmer further comprising:

a spring tensioner secured in the base housing by a tensioner latch that engages the tensioner catch, the spring tensioner securing the spring under tension.

3. The hair trimmer of claim 2, wherein:

the blade set support includes a forward portion and a rearward portion, the rearward portion being opposite to the forward portion, the tensioner catch being on the rearward portion.

4. The hair trimmer of claim 3, wherein the blade set support has a lower portion at an oblique angle to the forward portion of the blade set support.

5. The hair trimmer of claim 4, wherein the blade set support has two spaced cavities on the lower portion of the blade set support, and a basin between the cavities.

6. The hair trimmer of claim 5, wherein the spring has spaced coils and the coils fit in the cavities in the lower portion of the blade set support.

7. The hair trimmer of claim 5, wherein:

the forward portion of the blade set support has an opening adjacent the basin, and the spring tensioner has a tensioner projection that goes through the opening when the spring tensioner is installed.

8. The hair trimmer of claim 3, wherein the motor is a rotary motor, the rearward portion of the blade set support being a motor mount extending laterally across the base housing, the motor mount having the tensioner catch, the tensioner latch engaging the tensioner catch to secure the spring tensioner in the base housing.

9. The hair trimmer of claim 1, wherein the cam follower has a blade protrusion for driving the reciprocating blade on a front side thereof and a cavity for the drive device on a back side thereof.

10. The hair trimmer of claim 1, wherein the motor is a rotary motor, and the drive device is an eccentric cam shaft on a cam that is rotated by the motor.

11. The hair trimmer of claim 1, wherein the motor is a vibrator motor, and the drive device is a drive arm on the vibrator motor.

12. A hair trimmer comprising:

a base housing, a motor and a blade set, the blade set having a stationary blade and a reciprocating blade, the base housing having a blade set support at one end thereof, a cam follower, a spring; and a spring tensioner having a groove that secures the spring under tension, the spring tensioner further having a latch on one end and a projection on another end for securing the spring tensioner to the base housing, the reciprocating blade being operably secured to the cam follower, and the stationary blade being secured to the base housing.

* * * * *